United States Patent [19]

Flynn et al.

[11] 4,243,357

[45] Jan. 6, 1981

[54] TURBOMACHINE

[75] Inventors: Patrick F. Flynn; Harold G. Weber; John M. Mulloy, all of Columbus, Ind.

[73] Assignee: Cummins Engine Company, Inc., Columbus, Ind.

[21] Appl. No.: 63,669

[22] Filed: Aug. 6, 1979

Related U.S. Application Data

[63] Continuation-in-part of Ser. No. 936,695.

[51] Int. Cl.[3] ..... F04D 29/28

[52] U.S. Cl. ..... 415/215; 416/188

[58] Field of Search ..... 415/205, 212 R, 213 R, 415/215, DIG. 1; 416/183, 185, 188

[56] References Cited

U.S. PATENT DOCUMENTS

| | | | |
|---|---|---|---|
| 2,037,880 | 4/1936 | Charavay | 415/213 R |
| 2,484,554 | 10/1949 | Concordia et al. | 415/213 R |
| 2,570,081 | 10/1951 | Szczeniowski | 415/215 |
| 2,576,700 | 11/1951 | Schneider | 416/183 |
| 3,788,765 | 1/1974 | Rusak | 415/213 R |

FOREIGN PATENT DOCUMENTS

| | | | |
|---|---|---|---|
| 568031 | 12/1958 | Canada | 415/213 R |

*Primary Examiner*—Leonard E. Smith

*Attorney, Agent, or Firm*—Neuman, Williams, Anderson & Olson

[57] ABSTRACT

A turbomachine, operable as a compressor or a turbine, for a compressible fluid is provided which includes a wheel having a plurality of vanes extending from a generally axial flow section to a generally radial flow section. Adjacent vanes define fluid passageways having a generally axially oriented section and a generally radially oriented section. Located substantially within the generally radially oriented sections of a predetermined number of passageways is a reference station which has a configuration such that the mean tangential dimension of said passageway at said reference station is no more than about 60% of the circumference of the rotor at that mean radius divided by the number of vanes at that radius. Each reference station serves to effect substantial attachment of the flowing fluid to the surfaces defining said passageway, particularly at low mass flow, and, thus, broaden the usable flow range of the turbomachine. A rounded vane end at the wheel periphery further serves to enhance said attachment.

16 Claims, 13 Drawing Figures

FIG. 1
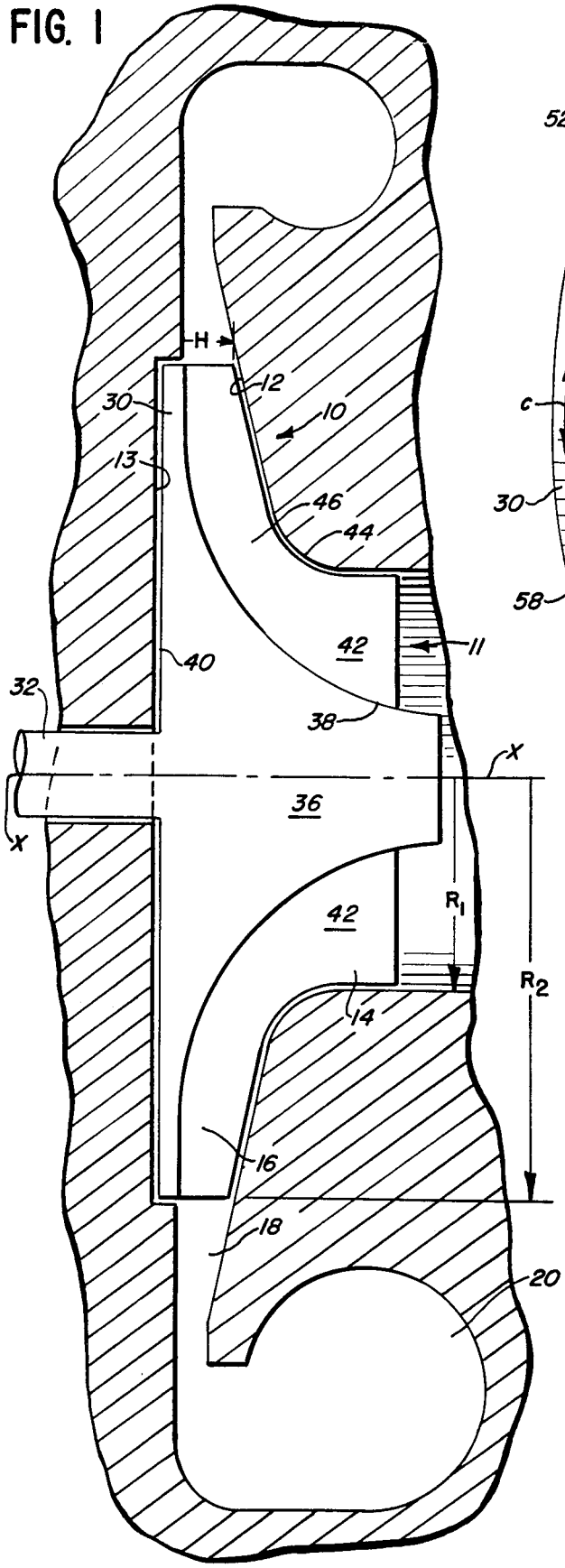
FIG. 2
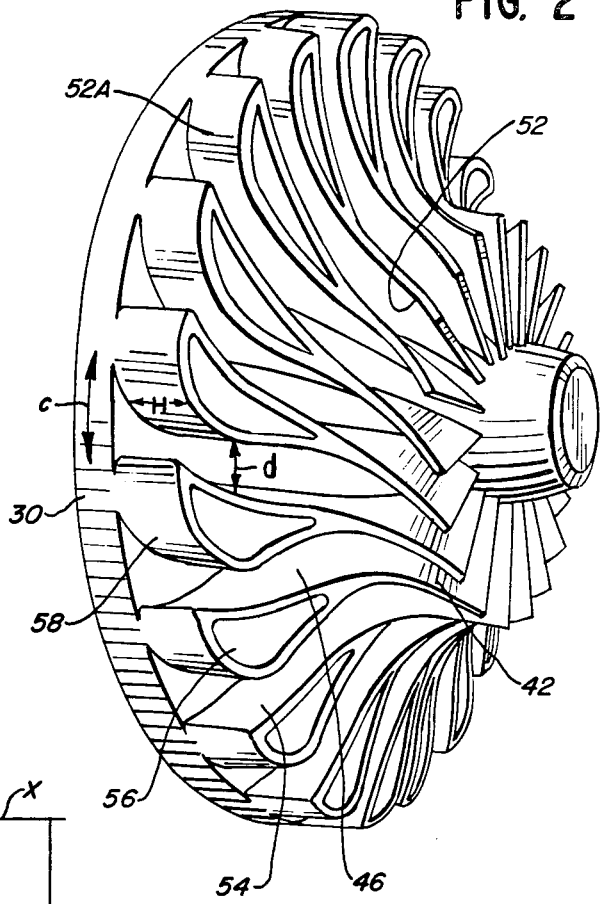
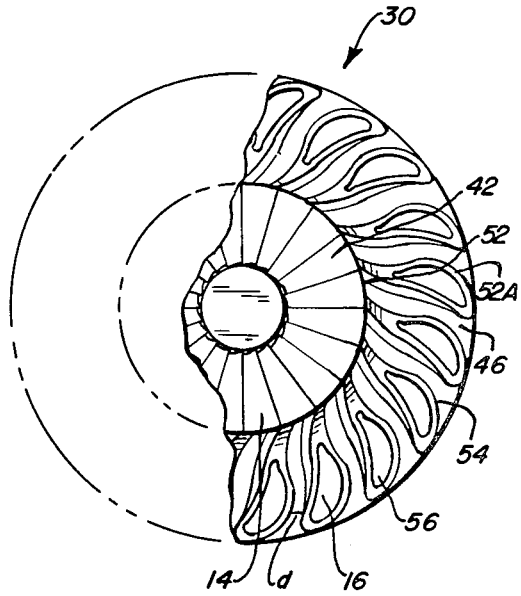
FIG. 2A

FIG. 3
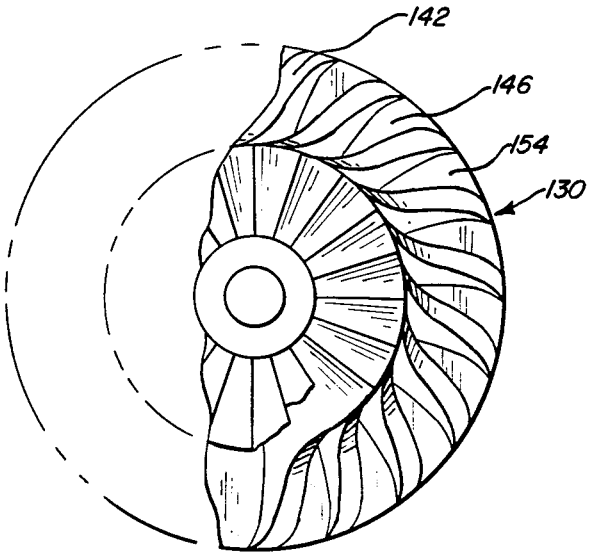
FIG. 5
PRIOR ART
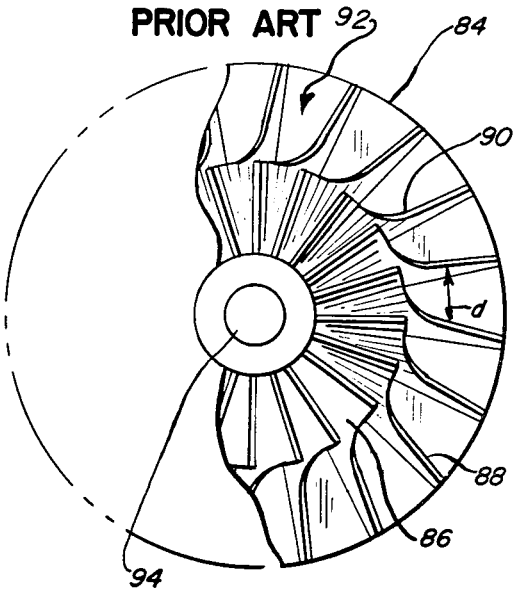
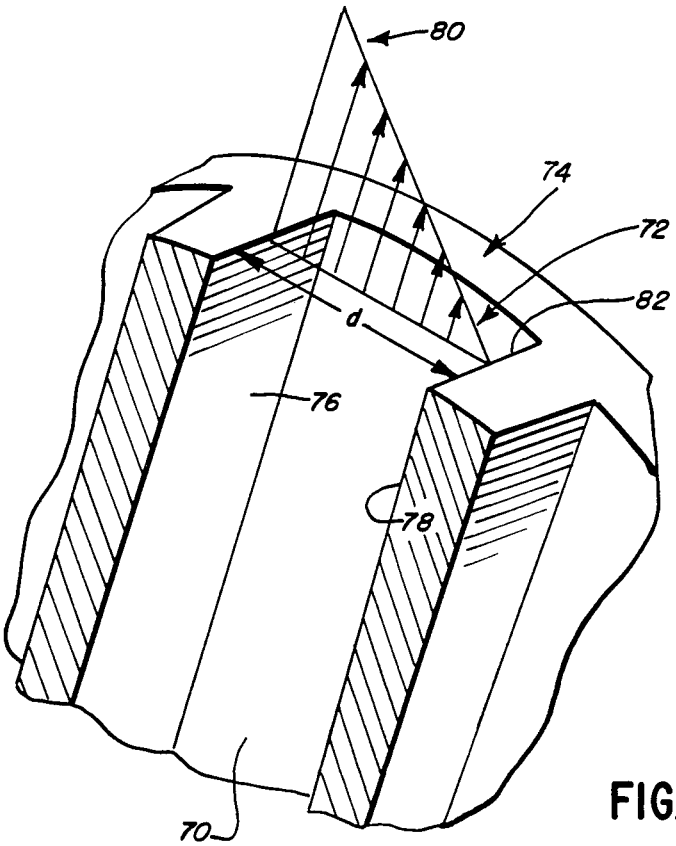
FIG. 4

TURBOMACHINE

BACKGROUND OF THE INVENTION

This application is a continuation-in-part application of applicants' copending application Ser. No. 936,695, filed Aug. 25, 1978.

Turbomachines have been used since the turn of the century to increase the energy level of a fluid in response to a rotating input, or to provide a rotatable output by extracting energy from a moving fluid. This is accomplished by directing a fluid flow through a series of appropriately shaped flow channels or passageways. A common objective has been to achieve a wide range of useable fluid flow rates.

Past attempts to extend the range of turbomachines of the type described have included variable geometry in the inlet and/or outlet section of such a turbomachine. However, these have the disadvantage of increased cost and complexity and are susceptible of malfunction. One attempt to achieve range extension with fixed geometry is the backward curvature impeller with backward leaning blades. Such a design approach offers only limited range extension at comparable wheel speeds, and then only at larger wheel diameters resulting in greater stress.

The useful operating range of a turbomachine at a given pressure ratio (i.e., outlet pressure divided by inlet pressure) is limited by two phenomena known as choke and surge. Choke limits the maximum amount of fluid mass flow which can pass through a given compressor and is normally caused by the flows reaching a mean velocity near sonic at some point in the flow path through the compressor. Surge, on the other hand, limits the minimum stable fluid mass flow rate which can be obtained at a given pressure ratio. Operating the turbomachine in the surge condition results in a severely unstable pulsating flow.

Within the usual operating range for a conventional centrifugal compressor, there may be a 30% to 40% variation in mass flow rate through the machine for a given turbomachine pressure ratio. If such a turbomachine is used in an application requiring variations in mass flow rates at given pressure ratios, the range of operation is limited to that between surge and choke. For example, when such a turbomachine is used as a turbocharger compressor, this variation limits the peak torque revolutions per minute of a reciprocating engine being serviced by the turbomachine to approximately 60% of its rated power revolutions per minute.

SUMMARY OF THE INVENTION

Thus, it is an object of the invention to provide an improved turbomachine of the type described which significantly increases the useful range of fluid mass flow rates at any given pressure ratio.

It is a further object of the invention to provide an improved turbomachine of the type described having a fixed geometry.

It is a further object of this invention to provide an improved turbomachine capable of operating through a large range of fluid mass flow rates at higher pressure ratios.

It is still a further object of this invention to provide an improved turbomachine capable of operating with a significant reduction in the surge mass flow rates at various rotational speeds.

It is still a further object of the present invention to provide an improved turbomachine which may be manufactured using conventional methods, practices, and materials.

Further and additional objects will appear from the description, accompanying drawings and appended claims.

In accordance with an embodiment of the invention, a compressible fluid turbomachine is provided comprising a rotor having protruding therefrom a plurality of vanes. Each vane has a first end proximate the axis of the rotor and a second end proximate the periphery of said rotor. The said second end is generally rounded and smoothly merges with the vane. The vanes coact with one another to define at least in part a plurality of fluid passageways extending between proximate the rotor axis to proximate the rotor periphery. Each passageway includes a generally axially oriented section having one end thereof adjacent the rotor axis and the opposite end thereof at a generally radially oriented section having an end adjacent the rotor periphery. Disposed substantially within the generally radially oriented section of a predetermined number of passageways is a reference station having a configuration such that the mean tangential dimension of said passageway at said reference station is no more than about 60% of the circumference of the rotor at that radius divided by the number of vanes at that mean radius.

DESCRIPTION OF THE DRAWINGS

FIG. 1 is a fragmentary cross-sectional view of one form of the improved turbomachine taken in a generally axial direction through oppositely disposed passageways.

FIG. 2 is a perspective top view of an embodiment of the improved turbomachine compressor rotor.

FIG. 2A is a top plan view of the compressor rotor of FIG. 1.

FIG. 3 is a top plan view of an alternate embodiment of the improved turbomachine compressor rotor.

FIG. 4 is a fragmentary perspective top view of an embodiment of the improved turbomachine rotor including a fluid velocity profile for a particular mass flow rate.

FIG. 5 is a top plan view of a standard turbomachine compressor rotor.

DESCRIPTION

Figure 6:
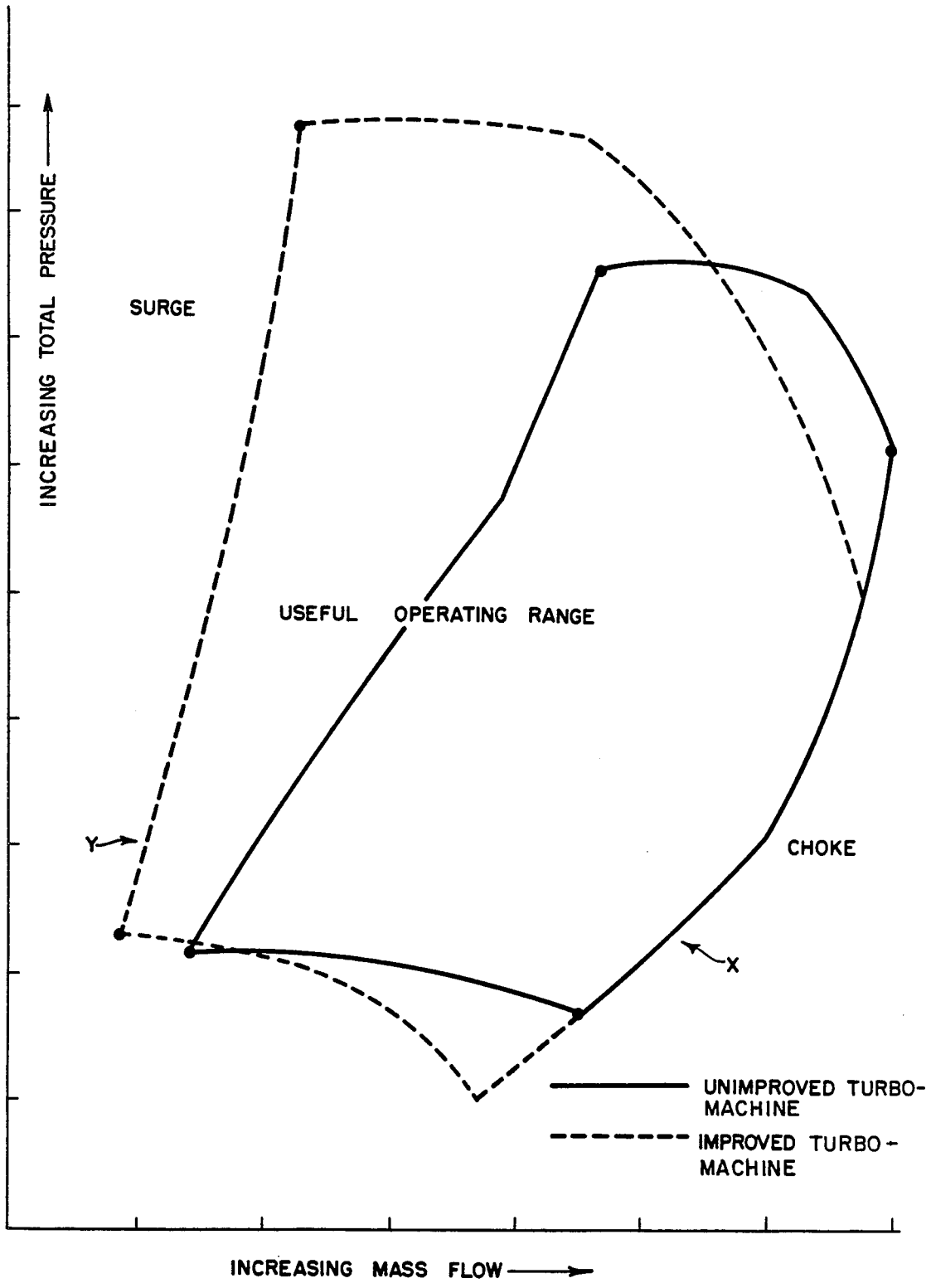
FIG. 6 is a graph comprising the operating characteristics of a standard turbomachine not incorporating the teachings of the present invention compared to an improved turbomachine which does incorporate the teachings of the present invention.

Referring now to FIG. 1, one form of the improved turbomachine 10 is shown which comprises a housing 12 having a chamber or cavity 13 in which a rotor 30 is mounted about an axis X—X. The housing cavity 13 is provided with an inlet 11 through which a compressible fluid flows from a suitable source, not shown. The entering fluid passes through the inlet 11 in a substantially axial direction relative to the axis of the rotor and is discharged from the cavity 13 through a peripheral outlet 20. In flowing from the inlet to the outlet the fluid flows successively through an axial section 14, and a radially oriented section 16; these sections defining at least in part flow passages. A discharge section 18 may be provided which coacts with the outlet 20 to form a voluted flow path. The configuration of the housing cavity 13 is dependent upon the configuration of the rotor 30. As an alternate to the housing a shroud may be attached to the rotor 30.

Rotor 30 is provided with a suitably journaled shaft 32 extending axially from one side thereof. When the rotor is a turbocharger compressor, the shaft 32 will normally be connected to a turbine wheel, not shown. It is to be noted that other rotary inputs may be utilized to drive the rotor. Rotor 30 has a hub 36 with a first face 38 exposed to the entering fluid and a second face 40 from which the shaft 32 projects. As illustrated in FIG. 1, the hub 36 has a sloped, generally truncated triangular cross-sectional configuration when an axial section is taken of the rotor 30. A plurality of symmetrically arranged vanes 42 are mounted on and project outwardly from the first face 38. It is to be understood that the symmetrical arrangement of the vanes is not critical. The vanes 42 form a generally fluid-tight seal 44 with the surface of the housing cavity 13 or the shroud, as the case may be, and define a plurality of continuous fluid passageways 46 having generally axially and radially oriented sections 14,16.

The portions of the vanes 42 disposed in the section 14 comprise an inducer section of the turbomachine 10 and the portion of the vanes 42 disposed within section 16 comprise a radial flow section. The maximum radius $R_2$ of the radial flow section is greater than the maximum radius $R_1$ of the inducer section, see FIG. 1. The entering fluid reacts with the inducer section before entering the radial flow section and is oriented thereby. The axial and radial flow sections for each passageway 46 are disposed in contiguous relation.

Referring to FIGS. 2 and 2A, vanes 42 are shown curving from within the inducer section to the outer periphery of the rotor 30. In the illustrated embodiment, the pressure side 52 of each vane 42 in the axial section 14 is generally concave; while the pressure side 52A is generally convex in the radial section 16. This streamlined curving shape provides an efficient energy transfer from the fluid to the rotor 30, or vice versa, as the fluid, which is generally inviscid and irrotational, has its direction of flow smoothly altered from axial to radial with respect to the rotor 30. It is to be noted that the surface configuration of the pressure sides of the vanes, as a matter of choice, may vary substantially from that shown without adversely affecting performance.

The configuration and number of passageways are determined by the total amount of fluid (mass flow rate) to be passed through the turbomachine, and the equation of state and ratio of specific heats for the fluid. The equation of state for said fluid is a function of its unique internal structure and is normally expressed as $pv=RT$ where p is the pressure of the gas, v is the specific volume of the gas, R is the specific gas constant, and T is the temperature. The ratio of specific heats for said fluid is the ratio of the change in enthalpy with respect to temperature divided by the change in internal energy with respect to temperature (dh/dT)/(du/dT). The total volume of fluid that passes through the turbomachine at any given pressure is the sum of the flow through each passageway formed in the turbomachine. Each passageway 46 has a tangential dimension, or vane-to-vane spacing d, and a height h, both of which may vary with respect to any position along the length of the passageway.

The velocity and pressure patterns or characteristics of the improved turbomachine maximize the attachment of the fluid to the vane surfaces and, thus, significantly enlarge the range of operations over conventional machines of this general type. In areas of separation, or non-attachment, of the fluid with respect to the vane surfaces reversals in flow direction may occur. In some aggravated situations, the fluid may establish an undesirable reverse flow circuit from one passageway into another, via the inlet or outlet.

To maximize and control attachment over a wide range of fluid mass flow rates, or to prevent any reverse fluid flows or interconnection of separation zones along the flow path, a reference station 54 is provided within the radial section 16 of each passageway. The station 54 constricts the passageway in its tangential dimension or blade-to-blade spacing d. If desired, the reference stations may be located arbitrarily within the passageways at different radii from the axis of the rotor; however, simplicity of design favors placing a like reference station at the same radius in each passageway. The mean tangential dimension d of each passageway at said reference station 54 is no more than about 60% of the mean circumference of the rotor measured at the reference station divided by the number of vanes intersecting the circumference. It is necessary to reduce the passageway in the tangential dimension to provide the desired attachment. Reducing the cross-sectional area or the dimension h will achieve only a minimal improvement in attachment and then only at the expense of a serious reduction in efficiency and a serious reduction in the choke mass flow rates.

While the said tangential constriction may assume any shape, it is preferably smoothly tapered to conform to the portions of the passageways disposed upstream and downstream thereof. In order to obtain substantially the same maximum mass flow through each passageway of the improved turbomachine, both ahead of and after, as well as at the reference station, it is necessary to increase the passageway height or axial dimension h at the reference station so as to compensate for the area reduction which would have been caused by solely reducing the tangential dimension d.

In the illustrated embodiment, in order to attain the desired vane-to-vane spacing d at the reference station, the portion of each vane so disposed in the radial section 16 of the passageway 46 has a transverse cross-sectional configuration 56 which is substantially wedge shaped or bulbous—that is to say, the thickness of the vane increases in the vicinity of the reference station and may diminish thereafter. To reduce the weight of the wheel the vanes in the radial section may be hollow if desired.

In order to demonstrate the use of the tangential dimension to prevent flow reversal at the reference station, a simplified calculation procedure will be outlined. It should be understood that the calculations have been simplified because this is merely an example to demonstrate the framework of the method when applied to a compressor rotor. It is assumed that the flow is inviscid, irrotational, and isentropic, and that the flow upstream of the rotor inducer section is purely axial. It is further assumed that the channel area per vane (A) at the reference station has been selected to satisfy a desired choke mass flow rate.

FIG. 4 shows a flow passageway 70 near the exit portion 72 of the periphery of the rotor 74 with both vane surfaces thereof substantially parallel and radial. It should be noted that the analysis (calculations) hereinafter described can be used for other passageway shapes, but in the selected example, the mathematics is much easier to understand based on the above assumptions. It can be shown that the relative velocity of the fluid in the passageway varies linearly from the suction surface to the pressure surface of the passageway forming vanes, and that the relative radial velocity difference across the passageway in the tangential direction is 2 $d\omega$, where $\omega$ is the angular velocity of the rotor in radians per unit time.

The passageway can accommodate a range of mass flow rates, but the velocity profile 80 shown is that for the particular mass flow rate which produces a zero relative radial velocity on the pressure surface vane 78. It will be assumed that this is the minimum flow rate necessary at the reference station 82 to control surge. It should also be noted that while FIG. 4 shows the reference station 82 at the periphery of the rotor, this is only for clarity in understanding the example.

With zero relative radial velocity at the pressure surface vane 78, the relative total temperature at this location may be found from:

$$T_{orel} = T_{oin} + (r\omega)^2/2c_p$$

where $T_{orel}$ is the relative total temperature $T_{oin}$ is the total temperature at the rotor inlet r is the radius to the reference station $c_p$ is the specific heat of the fluid at constant pressure (dh/dT).

The relative total pressure at this same point on the pressure surface vane 78 at the reference station 82 can then be found from:

$$P_{orel} = P_{oin}\left(\frac{T_{orel}}{T_{oin}}\right)^{\frac{\gamma}{\gamma-1}}$$

where $P_{orel}$ is the relative total pressure at the reference station radius $P_{oin}$ is the rotor inlet total pressure $\gamma$ is the specific heat ratio of the fluid (dh/dT)/(du/dT).

Since there is no flow at this point on the pressure surface vane, the static pressure is equal to the relative total pressure at the reference station radius, or $$P_{spressure\ surface} = P_{orel}$$

where $P_{spressure\ surface}$ is the static pressure of

-continued the fluid at the pressure surface vane at the reference station.

On the suction surface vane 76 at the reference station 82, the relative radial velocity of the fluid is 2 $d\omega$ and the local static temperature of the fluid is:

$$T_{ssuction\ surface} = T_{oin} + \frac{(r\omega)^2 - 2d\omega}{2c_p}$$

where $T_{ssuction\ surface}$ is the static temperature of the fluid at the suction surface vane at the reference station.

Since the relative fluid velocities at the reference station are assumed to be radial, $T_{oref}$ is constant across the station and can be found from $$T_{oref} = T_{oin} + (r\omega)^2/c_p$$

where $T_{oref}$ is the total temperature of the fluid at the reference station.

For isentropic flow, $$P_{oref} = P_{oin}\left(\frac{T_{oref}}{T_{oin}}\right)^{\frac{\gamma}{\gamma-1}}$$

where $P_{oref}$ is the total pressure of the fluid at the reference station then the static pressure of the fluid at the suction surface vane 76 at the reference station 82 can be found from $$P_{ssuction\ surface} = P_{oref}\left(\frac{T_{ssuction\ surface}}{T_{oref}}\right)^{\frac{\gamma}{\gamma-1}}$$

where $P_{ssuction\ surface}$ is the static pressure at the suction surface vane at the reference station.

The following equation can be obtained from a torque balance on the rotor (not shown):

$$P_{spressure\ surface} - P_{ssuction\ surface} = \frac{2\omega md}{A}$$

where A = dh where m is the desired mass flow rate per passageway. The above equations can be solved by an iterative process for d, the required tangential dimension of the passageway at the reference stations.

While it may seem possible to provide narrow passageways by adding more vanes, this approach is impractical because of the adverse effects produced in the axial section 14 of the turbomachine. The number of vanes provided on a rotor determines the amount of blockage the vanes will cause at the inlet of the turbomachine. The dimensions of the vanes must be such as to provide sufficient strength and stability to the vanes at high rotational speeds and to control critical vibration frequencies. The inclusion of additional vanes normally requires that the radius $R_1$ of the axial section 14 be increased in order to maintain the same fluid mass flow rate with the result that supersonic inlet fluid flows occur relative to the inducer section vane tips and create a series of shock waves. It has been found that the passage of the fluid through these shock waves causes a significant efficiency degradation. It is also impractical to insert additional vanes as splitters in the radially oriented section because the separation occurring upstream in the inducer would result in some passageways carrying almost no fluid or having a reverse fluid flow.

FIG. 3 illustrates an alternate embodiment of the improved rotor 130 wherein the passageways 146 thereof are restricted in the tangential dimension to form reference stations 154 which are disposed closer to the periphery of the rotor than in the case of rotor 30. The configuration of both the vanes and passageways may be further modified from the illustrated embodiments so as to satisfy certain design, stress, and inertia requirements or limitations.

Referring now to FIG. 5, a standard turbomachine compressor rotor 84 as known in the prior art includes an axially oriented flow section 86 and a radially oriented flow section 88 with a plurality of thin walled vanes 90 coacting to form fluid passageways 92. However, as readily apparent from FIG. 5, the thin walled vanes 90 result in ever widening passageways with an increasing vane-to-vane spacing d. Accordingly, said passageways steadily increase in width d proportional to the distance from the axis 94 of the rotor and have no reference station as disclosed herein.

Referring to the graph of FIG. 6, a compressor map X depicting the useful operating range (shown in solid lines) of the unimproved turbomachine (see FIG. 5), has been superimposed over a similar compressor map Y depicting the useful operating range (shown in broken lines) of an improved turbomachine (see FIG. 2). The increase in the useful operating range of the improved turbomachine is readily apparent. As explained earlier, the useful operating range of a turbomachine is limited by two phenomena known as choke and surge. Choke limits the maximum amount of fluid mass flow which can pass through a compressor, and surge limits the minimum stable fluid mass flow rate which can be obtained at a given pressure ratio. Accordingly, the turbomachine should be operated between these two limits to maintain acceptable efficiencies and stable operation. The pressure ratio is outlet pressure divided by inlet pressure (ordinate in the graph of FIG. 6), and varies typically from one to four, but may be larger. The mass flow rate is the mass of fluid passing through the turbomachine per unit of time (abscissa in the graph of FIG. 6), and varies according to the particular rotor design. As demonstrated in FIG. 6, using turbomachines with comparable mass flow rates and efficiencies, both turbomachines have similar mass flow rates in the higher flow range, yet the improved rotor has significantly expanded the range of mass flow rates at lower mass flows. This results in significantly improved ratios of choke mass flow rates to surge mass flow rates at any given pressure ratio.

The use of an improved turbomachine as described by the teachings herein can provide many advantages to overall system operation in a variety of applications. To illustrate some of these advantages, consider such a turbomachine used as a compressor in two different systems using turbo compressors: engine turbocharging and motor driven air compressors.

When an improved turbomachine as described herein is used as a compressor on an engine turbocharger, the wider allowable range of mass flow rates allows a wider range of engine speeds within the turbocharger's stable operating range. This allows a smaller number of transmission gear ratios when such an engine is used in traction service. In addition, when such a compressor is used with a variable geometry turbine in a turbocharger, a greater flexibility in torque curve shaping exists along with the capability to run the engine at higher torque levels over a broader speed range. In addition, the low mass flow rate placement of the compressor surge line allows the operation of the engine at high altitudes without encountering compressor surge as a limiting constraint.

When an improved turbomachine as described herein is used in the compressor stage of motor driven air compressor systems, a great reduction in partial output power requirements can be achieved. When a conventional system is used, for instance, as a plant air supply, the system is sized to provide the maximum flow rate required at the desired system pressure. Many of these systems operate a considerable amount of the time at conditions that demand a very small fraction of the system's maximum output capability, or even in a standby mode. If such a system is used with conventional compressors designed with the previous state-of-the-art knowledge, the lack of compressor stability at low mass flow rates requires the machine to operate at high mass flow rates even when system demand is low. This results in wasted energy consumption and the extra mass flow above system demand is discharged to the surroundings. During such times the wide range of the improved compressor disclosed herein allows stable operation of the system at the desired output pressure and low mass flows, thus lowering overall system power consumption while retaining the ability to provide higher mass flow rates at the desired pressure.

It is, of course, obvious that although most of the discussion presented thus far relates to the use of such a turbomachine as a compressor, the relationships described herein are not affected by the direction of fluid flows through the rotor. Thus, the concepts presented herein are as applicable to radial inflow turbines as they are to axial inflow compressors.

When the turbomachine is operated as a turbine with a radial inflow and axial outflow, the inlet gas flow angles relative to the wheel vary substantially and rapidly, even during steady state operation. These variations occur on the order of milliseconds and may result in part from a pulsating fluid source, such as the exhaust flow of an internal combustion engine.

Figure 7:
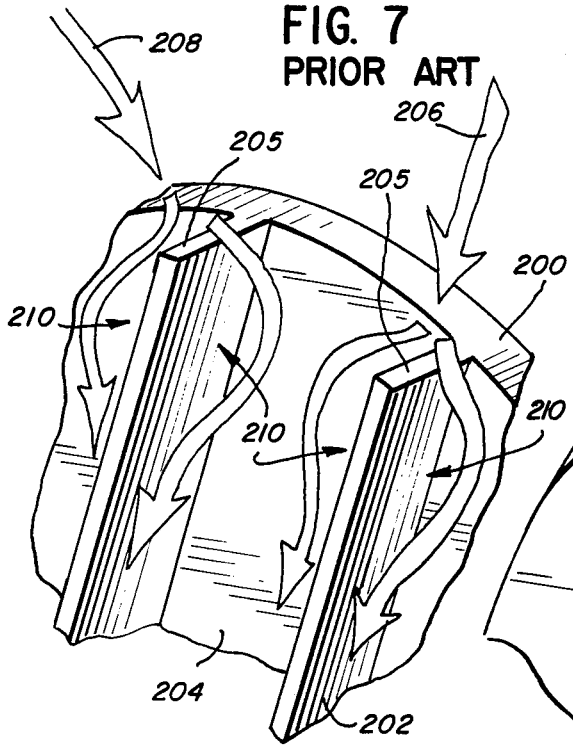
FIG. 7 PRIOR ART
FIG. 7 is a fragmentary perspective top view of a standard turbomachine rotor including fluid flow profiles.

FIG. 7 is a fragmentary perspective top view of the radial portion of a standard turbomachine rotor 200 having vanes 202 extending thereacross forming, in part, fluid passageways 204. Said vanes are thin and generally flat at their peripheral ends 205. The incoming fluid is diagrammatically depicted as 206 and 208, to represent two of the various angles of incidence. These variations in relative gas inlet angle produce undesirable areas of fluid separation 210 from the vane 202 in the radial portion of the wheel as the fluid flows over the peripheral ends 205. These separation zones are believed to extend the length of the entire fluid passageway 204 under certain conditions, thereby limiting operation ranges.

Figure 8:
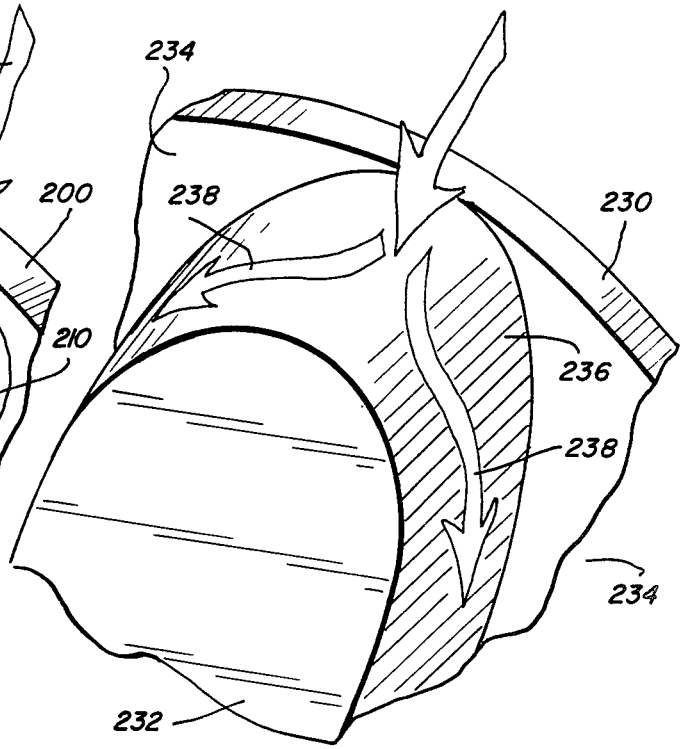
FIG. 8 is a fragmentary perspective top view of an improved turbomachine rotor including fluid flow profiles.
Figure 9:
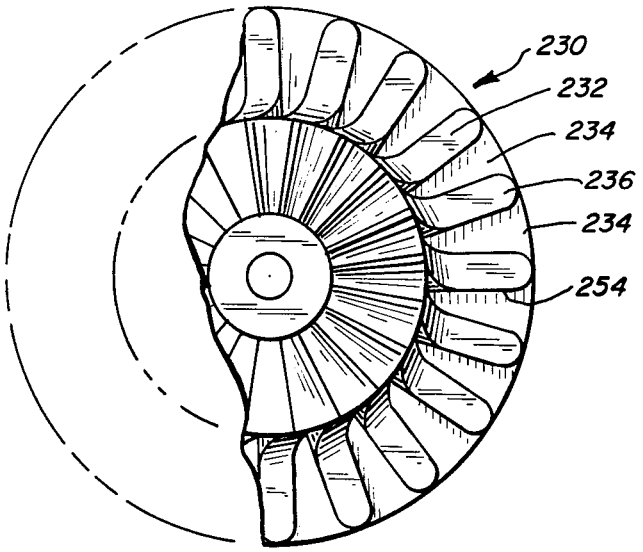
FIG. 9 is a top plan view of an improved turbomachine turbine rotor including a reference station and a rounded inlet vane end.

Referring now to FIGS. 8 and 9, an improved turbomachine rotor 230 has a vane 232 extending thereacross forming, in part, fluid passageways 234. To suppress inlet separation, the vane end 236 at the periphery of the wheel has a generally rounded or blunt air foil shape which smoothly merges with the vane. This shape generally conforms to the air flow, diagrammatically shown as 238, thereby reducing separation and increasing the off-design mass flow. The rounded vane end may conveniently be used in conjunction with a reference station 254 as earlier disclosed, and the wide vanes associated therewith permit a maximum radius of curvature at the vane end to minimize separation. If the angles of incidence vary widely, the rounded vane end 236 perferably assumes a generally semi-circular cross section to accommodate a variety of said angles. Said vanes, as well as those in FIGS. 10 and 11, may be hollow or solid, as compatible with other design requirements or desires.

Figure 10:
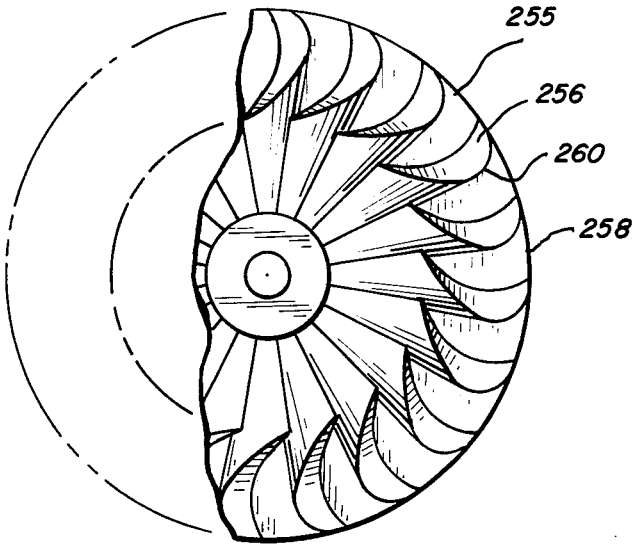
FIGS. 10 and 11 are top plan views of alternate embodiments of improved turbomachine turbine rotors including reference stations and rounded inlet vane ends.

Referring now to FIG. 10, an alternate emodiment of a rotor 255 having a rounded vane end 256 is disclosed. If the angles of incidence of the incoming fluid are generally confined to a smaller known range of variations, the rounded vane ends 256 may be curved into the incoming fluid to permit a maximum radius of curvature to minimize separation. The wheel 258 may also include a reference station 260.

Figure 11:
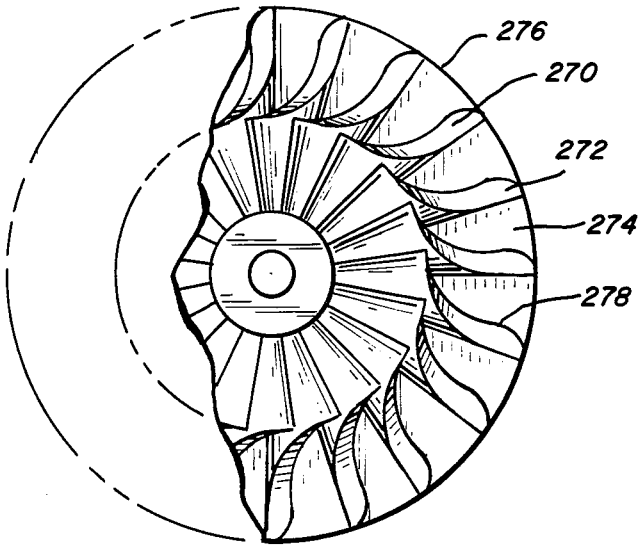

Referring now to FIG. 11, a still further alternate embodiment of a rotor 276 is disclosed. The vane 270 has a rounded, partially circular vane end 272, and the passageway 274 is widened to accommodate a higher mass flow rate at relatively high rotor speeds. The wheel may also include a reference station 278.

Figure 12:
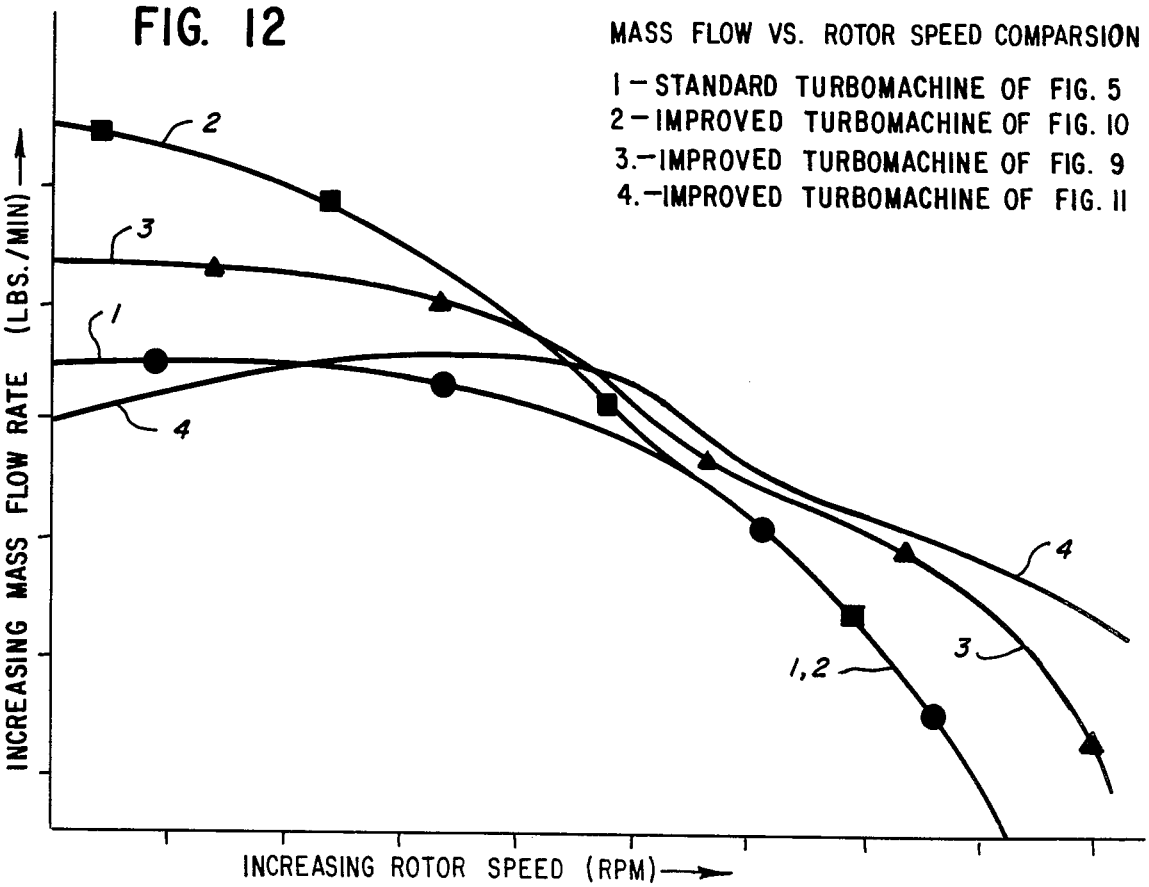
FIG. 12 is a graph of mass flow versus rotor speed comparing a standard turbomachine to improved turbomachines incorporating the rotors of FIGS. 7–9.

Referring to FIG. 12, a graph of mass flows versus rotor speeds compares a standard turbomachine at line 1, to the improved turbomachines incorporating the rotors of FIGS. 7–9. All of the improved wheels demonstrate significant off-design increases in mass flows, and the different designs permit one to optimize performance over a limited range or the entire range of operations.

As with the alternate embodiments disclosed herein, it is apparent that this invention is capable of various modifications in the shapes of the passageways and vanes. The teachings of this invention may also be incorporated for use with various fluid sources and diffusers, both vaned and vaneless. Further, a compressor or turbine wheel manufactured in accordance with the teachings of this invention may be constructed in any suitable manner using conventional methods and materials. Accordingly, while the invention disclosed herein has been described with reference to a preferred embodiment, it is to be understood that this disclosure is to be interpreted in its broadest sense and encompass the use of equivalent apparatus and mechanisms.

What is claimed is:

1. A turbomachine for compressible fluids comprising a rotor mounted for rotation about a substantially central transverse axis, said rotor including a hub, and a plurality of vanes mounted on and projecting from one surface of said hub, each vane being between the rotor axis and the rotor periphery and having a generally rounded vane end at said periphery smoothly merging with said vane, adjacent vanes coacting to define at least in part a fluid passageway having a generally axially oriented section adjacent the rotor axis and a generally radially oriented section extending from said axially oriented section to the rotor periphery; a predetermined number of passageways each having a reference station provided with a generally tangentially oriented construction and disposed within the radially oriented section thereof, the passageway configuration at said reference station having a mean tangential dimension that is no more than about 60% of the mean circumference of the rotor measured at said reference station divided by the number of vanes intersecting said circumference.

2. The turbomachine of claim 1 wherein the passageway configuration at each reference station has an axial dimension that exceeds the tangential dimension.

3. The turbomachine of claim 1 wherein a surface portion of one of the vanes disposed within the radially oriented passageway section has a generally convex configuration and is adjacent a pressure side of the fluid flow through the radially oriented passageway section, and a surface portion of one of the vanes disposed within the axially oriented passageway section has a generally concave configuration and is adjacent a pressure side of the fluid flow through the axially oriented passageway section.

4. The turbomachine of claim 1 wherein the portion of a passageway extending from the generally axially oriented section to the reference station has a mean tangential dimension decreasing towards the mean tangential dimension at said reference station.

5. The turbomachine of claim 1 wherein the portion of a passageway extending from the reference station to the rotor periphery has an increasing means tangential dimension relative to the mean tangential dimension at said reference station.

6. The turbomachine of claim 1 wherein the portion of each vane starting from the axially oriented section to the reference station has an increasing tangential cross-sectional area.

7. The turbomachine of claim 1 wherein the vanes are symmetrically arranged on said hub surface and said reference stations are uniformly spaced from the rotor axis.

8. The turbomachine of claim 1 wherein the edges of said vanes spaced from the hub surface are fixedly secured to an imperforate shroud whereby said shroud, said vanes and said hub surface coact to form said fluid passageways.

9. The turbomachine of claim 1 wherein each vane end adjacent the rotor periphery has a generally semi-circular cross-sectional configuration.

10. The turbomachine of claim 1 wherein the generally radially oriented flow port section constitutes a flow inlet section and each vane end adjacent the rotor periphery is curved toward the direction of the incoming fluid relative to the vane.

11. The turbomachine of claim 1 wherein the portion of a passageway extending from the generally axially oriented section to the reference station has a mean tangential dimension decreasing towards the mean tangential dimension at said reference station and the portion of said passageway extending from the reference station to the rotor periphery has an increasing mean tangential dimension relative to the mean tangential dimension at said reference station.

12. The turbomachine of claim 1 wherein the axial dimension of each passageway is increased proximate said reference station to compensate for the passageway area reduction resulting from said construction.

13. The turbomachine of claim 1 wherein the rotor is mounted within a circular cavity formed in a housing, said housing having a generally axially oriented flow port section and a generally radially oriented flow port section, said sections communicating with said cavity.

14. The turbomachine of claim 13 wherein one end of each vane is disposed adjacent one flow port section and an opposite end of each vane is disposed adjacent the other flow port section.

15. The turbomachine of claim 13 wherein each passageway extending from one flow port section to the other flow port section is substantially continuous and undivided.

16. The turbomachine of claim 13 wherein the vanes of said rotor sealingly engage cavity-forming surfaces of said housing.

* * * * *

UNITED STATES PATENT AND TRADEMARK OFFICE

CERTIFICATE OF CORRECTION

PATENT NO. : 4,243,357

DATED : January 6, 1981

INVENTOR(S) : Patrick F. Flynn, Harold G. Weber and John M. Mulloy

It is certified that error appears in the above-identified patent and that said Letters Patent are hereby corrected as shown below:

Column 9, line 67, delete "construction" and insert --constriction--.

Column 10, line 25, delete "means" and insert --mean--;

line 61, delete "construction" and insert --constriction--.

Signed and Sealed this

Fourth Day of August 1981

[SEAL]

Attest:

GERALD J. MOSSINGHOFF

Attesting Officer

Commissioner of Patents and Trademarks

UNITED STATES PATENT AND TRADEMARK OFFICE

CERTIFICATE OF CORRECTION

PATENT NO. : 4,243,357

DATED : January 6, 1981

INVENTOR(S) : Patrick F. Flynn, Harold G. Weber, and John M. Mulloy

It is certified that error appears in the above-identified patent and that said Letters Patent are hereby corrected as shown below:

Column 6, line 10, $$"T_{s_{\substack{\text{suction}\\ \text{surface}}}} = T_{o_{in}} + \frac{(r\omega)^2 - 2d\omega}{2c_p}"$$

Should read:

$$--T_{s_{\substack{\text{suction}\\ \text{surface}}}} = T_{o_{in}} + \frac{(r\omega)^2 - (2d\omega)^2}{2c_p}--$$

Signed and Sealed this

Sixth Day of July 1982

[SEAL]

Attest:

GERALD J. MOSSINGHOFF

Attesting Officer

Commissioner of Patents and Trademarks